United States Patent [19]

Fischer

[11] 4,136,020

[45] Jan. 23, 1979

[54] FLOTATION REAGENT AND PROCESS

[75] Inventor: Arthur H. Fischer, New York, N.Y.

[73] Assignee: Minerec Corporation, New York, N.Y.

[21] Appl. No.: 740,844

[22] Filed: Nov. 11, 1976

[51] Int. Cl.[2] ..... B03D 1/02

[52] U.S. Cl. ..... 209/166; 252/61; 260/455 A

[58] Field of Search ..... 209/166; 252/61; 260/455 A

[56] References Cited

U.S. PATENT DOCUMENTS

| | | | |
|---|---|---|---|
| 1,394,640 | 10/1921 | Perkins | 209/166 |
| 1,640,218 | 8/1927 | Sayre | 209/166 |
| 1,652,099 | 12/1927 | Douglass | 209/166 |
| 1,847,664 | 3/1932 | Ney | 209/166 |
| 2,024,925 | 12/1935 | Hirschkind | 209/166 X |
| 2,070,634 | 2/1937 | Weintz | 252/61 X |
| 2,278,020 | 3/1942 | Ralston | 209/166 |
| 2,412,500 | 12/1946 | Fischer | 209/166 |
| 2,629,494 | 2/1953 | Brown | 209/166 |
| 2,644,580 | 7/1953 | Robbins | 209/166 |
| 2,691,635 | 10/1954 | Harris | 252/61 |
| 2,711,421 | 6/1955 | Mull | 260/455 A |
| 3,425,550 | 2/1969 | Baarson | 209/166 |
| 3,855,263 | 12/1974 | Melloni | 260/455 A X |

FOREIGN PATENT DOCUMENTS

| | | | |
|---|---|---|---|
| 507566 | 6/1974 | U.S.S.R. | 260/455 A |

*Primary Examiner*—Robert Halper

*Attorney, Agent, or Firm*—James J. Burke, II

[57] ABSTRACT

The performance of xanthogen formates as reagents for the flotation of sulfide copper ores is significantly improved by reacting the xanthogen formate with an aromatic amine. In a preferred embodiment, up to about 20% of an aromatic diamine, most particularly o-phenylene diamine and o-toluene diamine, is used.

6 Claims, No Drawings

FLOTATION REAGENT AND PROCESS

BACKGROUND OF THE INVENTION

The present invention relates generally to flotation reagents and, more particularly, to xanthogen formate flotation reagents useful in the concentration of copper sulfide ores. The invention is carried out by reacting aromatic amines with an excess of alkyl xanthogen formate, in various proportions, to yield a stable composition of unreacted xanthogen formate and a complex mixture of the reaction products.

Alkyl xanthogen formates are defined by the general formula $$ROC(=S)-S-C(=O)OR'$$

where R and R' are lower alkyl radicals, generally with 1 to 6 carbon atoms. These compounds have been successfully used as reagents for the flotation of sulfide copper ores for over thirty years (see U.S. Pat. No. 2,412,500, issued Dec. 10, 1946). They are generally referred to as flotation promoters, and are used in conjunction with other well known flotation reagents, e.g. pine oil, methyl isobutyl carbinol (MIBC), lime, cyanide, etc.

Copper sulfide ores are complex, both physically and chemically, and they are quite variable, even on a day-to-day basis from the same source. The flotation process itself has a large number of variables, and some of these are difficult to control and even to measure. Because of this complexity, the process of finding new and improved flotation promoters, while grounded in chemical theory, relies on side-by-side comparisons of such compounds and known promoters, with all other conditions being held the same.

OBJECTS OF THE INVENTION

A general object of the present invention is to provide an improved flotation reagent of the xanthogen formate type.

Another object of the present invention is to provide an improved flotation reagent for copper sulfide ores.

A more particular object of the present invention is to provide a flotation reagent specifically adapted for the leach/precipitation/flotation method of treating oxidized copper sulfide ores.

Various other objects and advantages of the invention will become clear from the following description of embodiments thereof, and the novel features will be particularly pointed out in connection with the appended claims.

DESCRIPTION OF EMBODIMENTS

The present invention is based on the discovery that aromatic amines not only react with xanthogen formates, but that a mixture of said formate with the product of the reaction (e.g. a reaction mixture including excess of the xanthogen formate) is an improved flotation promoter and frother. The mixture is stable, and is considerably more active as a flotation promoter than the xanthogen formate alone.

The aromatic diamines which are preferred are the simplest available: phenylene diamine (diamino benzene) and toluene diamine. Monoamines which may be used include toluidine and xylidine. The ortho isomers are generally preferred.

The dialkyl xanthogen formates used are those with proven utility as flotation promoters: amyl xanthogen ethyl formate, ethyl xanthogen ethyl formate, butyl xanthogen ethyl formate, isopropyl xanthogen ethyl formate, etc.

The reaction is somewhat exothermic with gas evolution, but the manner in which it is carried out is not deemed critical. The preferred procedure with diamines is to cool the xanthogen formate to about 15° C. The diamine is melted, as most are solid at room temperature (o-phenylene diamine melts at 102° C.; o-tuluene diamine melts at 64° C.). Under conditions of agitation, the amine is added slowly to the xanthogen formate. Gas evolution is observed to cease after about 15 minutes and the temperature of the mixture rises to about 40° C. Stirring is continued for another hour, and the product is cooled and packed. The only critical aspect of the reaction is that all of the amine react and that there be an excess of unreacted xanthogen at completion. With the monoamines, the reactants (liquids) can be mixed at room temperature, and the mixture will rise to about 60° C.

Monoamines can be used in up to about molecular proportions, roughly 40% (all percentages are weight percent) of the reactants. Diamines, by contrast, should not be added in excess of about 20% of the reactant weight, as higher additions produce a sticky and unmanageable product. Thus, the preferred addition levels for the aromatic monoamines is 5–40% and for the diamines it is 5–20%.

It is known that when the reactants are 80% xanthogen and 20% diamine, about 80% of the former reacts, so the 20% diamine addition is considered a safe upper limit.

The invention is particularly advantageous in the treatment of partially oxidized copper ores treated by the leach/precipitation/float, or LPF process. The ore is initially leached with an acid to dissolve soluble constituents, and then cemented on iron to precipitate dissolved copper. The resulting pulp is then subjected to froth flotation to recover a sulfide concentrate.

In Examples 1–12, aqueous pulps with a pH of approximately 2.0 containing sulfide ore and cement copper resulting from leach-precipitation treatment of partially oxidized sulfide ore of the compositions indicated with respect to copper, were subjected to froth flotation operations in the presence of the reagents indicated, but otherwise under substantially identical conditions with the production of concentrate and tailing products of the analyses shown. In the examples .28 lbs of the reagents were employed, together with 0.12 lbs of pine oil per ton of ore. The brackets are intended to indicate a reacted mixture including excess formate.

Examples 1–6

Ore Assaying .91% Cu

| Reagents | Concentrate % Cu | Tailing % Cu |
|---|---|---|
| 1. Ethyl xanthogen ethyl formate | 6.61 | 0.186 |
| 2. (90% ethyl xanthogen ethyl formate +10% o-phenylene diamine) | 7.12 | 0.135 |
| 3. (90% isopropyl xanthogen ethyl formate +10% o-phenylene diamine) | 8.32 | 0.132 |
| 4. (90% n-butyl xanthogen ethyl formate +10% o-phenylene diamine) | 7.62 | 0.110 |
| 5. (95% n-butyl xanthogen ethyl formate +5% o-phenylene diamine) | 8.62 | 0.126 |
| 6. (90% isobutyl xanthogen ethyl for- | | |

Examples 1–6-continued

| Ore Assaying .91% Cu | | |
|---|---|---|
| Reagents | Concentrate % Cu | Tailing % Cu |
| mate +10% o-phenylene diamine) | 7.62 | 0.116 |

Examples 7–12

| Ore Assaying 1.196% Cu | | |
|---|---|---|
| Reagents | Concentrate % Cu | Tailing % Cu |
| 7. Butyl xanthogen ethyl formate | 8.69 | 0.283 |
| 8. (90% butyl xanthogen ethyl formate +10% o-phenylene diamine) | 7.77 | 0.204 |
| 9. (90% butyl xanthogene ethyl formate +10% o-toluene diamine) | 8.38 | 0.170 |
| 10. Amyl xanthogen ethyl formate | 8.07 | 0.289 |
| 11. (90% amyl xanthogen ethyl formate +10% o-phenylene diamine) | 8.58 | 0.207 |
| 12. (90% amyl xanthogen ethyl formate +10% o-toluene diamine) | 7.66 | 0.179 |

In the following examples, sulfide ores of the composition indicated with respect to copper were ground in water to form aqueous pulps which were subjected to froth flotation operations in the presence of the reagents indicated but otherwise under identical conditions with the production of concentrate and tailing products of the analyses indicated.

Example 13

| Ore Assaying .601% Cu | | | |
|---|---|---|---|
| Concentrate % Cu | 14.22 | 14.05 | 15.02 |
| Tails % Cu | 0.151 | 0.138 | 0.141 |
| % Recovery Cu | 75.70 | 77.87 | 77.04 |
| Reagents: Lbs. per ton | | | |
| Lime | 4.0 | 4.0 | 4.0 |
| Pine oil | .06 | .06 | .06 |
| Butyl ethyl thionocarbamate | .04 | — | — |
| (90% amyl xanthogen ethyl formate +10% o-phenylene diamine) | — | .04 | — |
| (90% ethyl xanthogen ethyl formate +10% o-toluene diamine) | — | — | .04 |

Example 14

| Ore Assaying .622% Cu | | | |
|---|---|---|---|
| Concentrate % Cu | 8.61 | 8.27 | 8.34 |
| Tails % Cu | .186 | .148 | .148 |
| % Recovery Cu | 71.70 | 77.65 | 77.65 |
| Reagents: Lbs per ton | | | |
| Lime | 6.0 | 6.0 | 6.0 |
| Burner oil | .04 | .04 | .04 |
| MIBC | .12 | .12 | .12 |
| Isopropyl ethyl thionocarbamate | .04 | — | — |
| (90% amyl xanthogen ethyl formate +10% o-phenelene diamine) | — | .04 | — |
| (90% amyl xanthogen ethyl formate +10% o-toluene diamine | — | — | .04 |

Example 15

| Ore Assaying .679% Cu | | | |
|---|---|---|---|
| Concentrate % Cu | 15.84 | 15.14 | 15.86 |
| Tails % Cu | .088 | .078 | .081 |
| % Recovery Cu | 87.48 | 88.94 | 88.56 |
| Reagents: Lbs. per ton | | | |
| Lime | .8 | .8 | .8 |
| Cyanide | .015 | .015 | .015 |
| MIBC | .18 | .18 | .18 |
| Sodium cresyl dithiophosphate | 0.34 | 0.34 | 0.34 |
| (80% butyl xanthogen ethyl formate +20% o-toluene diamine) | — | .01 | — |
| (80% methyl amyl xanthogen ethyl formate +20% o-toluene diamine) | — | — | .01 |

Example 16

| Ore Assaying .906% Cu | | |
|---|---|---|
| Concentrate | 10.43 | 9.01 |
| Tails % Cu | .272 | .219 |
| % Recovery Cu | 71.6 | 77.6 |
| Reagents: Lbs per ton | | |
| Lime | 5.4 | 5.4 |
| Burner oil | .08 | .08 |
| Pine oil | .08 | .08 |
| Isopropyl ethyl thionocarbamate | .06 | — |
| (90% amyl xanthogen ethyl formate +10% o-phenylene diamine) | — | .06 |

The actual reaction mechanism between the xanthogen formate and the aromatic diamine is not known with precision; a large number are possible, and it is known that both mono- and di-substituted products result. The invention is thus defined as the reaction product of xanthogen formate and an aromatic amine, generally in the presence of excess formate.

Examples 17–21 show the improved recoveries that are attained when the promoter is a xanthogen formate and the reaction product of the formate and a monoamine.

Example 17

| Ore Assaying .804% Cu | | |
|---|---|---|
| Concentrate % Cu | 7.18 | 7.00 |
| Tails % Cu | .155 | .140 |
| % Recovery | 82.46 | 84.33 |
| Reagents: Lbs. per ton | | |
| Lime | 3.2 | 3.2 |
| MIBC | .08 | .08 |
| Sodium isopropyl xanthate | .01 | .01 |
| Ethyl xanthogen ethyl formate | .03 | — |
| (80% ethyl xanthogen formate +20% o-toluidine) | — | .03 |

Example 18

| Ore Assaying .804% Cu | | |
|---|---|---|
| Concentrate % Cu | 6.42 | 6.45 |
| Tails % Cu | .153 | .142 |
| % Recovery | 82.96 | 84.20 |
| Reagents: Lbs. per ton | | |
| Lime | 3.2 | 3.2 |
| MIBC | .08 | .08 |
| Sodium isopropyl xanthate | .01 | .01 |
| Ethyl xanthogen ethyl formate | .03 | — |
| (72% ethyl xanthogen ethyl formate +28% o-toluidine) | — | .03 |

Example 19

| Ore Assaying .818% Cu | | | |
|---|---|---|---|
| Concentrate % Cu | 7.43 | 7.20 | 6.26 |
| Tails % Cu | .136 | .132 | .128 |
| % Recovery Cu | 84.96 | 85.45 | 86.06 |
| Reagents: Lbs per ton | | | |
| Lime | 2.8 | 2.8 | 2.8 |
| MIBC | .08 | .08 | .08 |
| Sodium isopropyl xanthate | .01 | .01 | .01 |
| Ethyl xanthogen ethyl formate | .03 | — | — |
| (95% ethyl xanthogen ethyl formate +5% o-toluidine) | — | .03 | — |
| (92% ethyl xanthogen ethyl formate +8% o-toluidine) | — | — | .03 |

Example 20

| Ore Assaying .818% Cu | | |
|---|---|---|
| Concentrate % Cu | 6.79 | 7.04 |
| Tails % Cu | .130 | .124 |
| % Recovery | 85.70 | 86.31 |
| Reagents: Lbs. per ton | | |
| Lime | 2.8 | 2.8 |
| MIBC | .08 | .08 |
| Sodium isopropyl xanthate | .01 | .01 |
| Ethyl xanthogen ethyl formate | .03 | — |
| (66% ethyl xanthogen ethyl formate | | |

Example 20-continued

| Ore Assaying .818% Cu | | |
|---|---|---|
| +34% o-toluidine) | — | .03 |

Example 21

| Ore Assaying .804% Cu | | |
|---|---|---|
| Concentrate % Cu | 7.84 | 6.73 |
| Tails % Cu | .151 | .138 |
| % Recovery | 82.83 | 84.45 |
| Reagents: Lbs. per ton | | |
| Lime | 2.8 | 2.8 |
| MIBC | .08 | .08 |
| Sodium isopropyl xanthate | .01 | .01 |
| Ethyl xanthogen ethyl formate | .03 | — |
| (63% ethyl xanthogen ethyl formate +37% xylidine) | — | .03 |

Various changes in the details, steps and materials, which have been herein described and illustrated in order to explain the invention, may be made by those skilled in the art within the principle and scope of the invention as defined in the appended claims.

What is claimed is:

1. A flotation promoter comprising a mixture of:
an alkyl xanthogen formate having alkyl radicals of 1–6 carbon atoms; and
the reaction products of said xanthogen formate and an aromatic amine selected from the group consisting of o-toluene diamine, o-phenylene diamine, o-toluidine and o-xylidene, said amine comprising 5–40 wt.% of the reaction mixture.

2. The flotation promoter as claimed in claim 1, wherein said amine is a diamine, and comprises about 5 to 20 wt.% of the reaction mixture.

3. A flotation promoter consisting essentially of a fully reacted mixture of an alkyl xanthogen formate with alkyl radicals of 1–6 carbon atoms and an aromatic diamine selected from the group consisting of o-toluene diamine and o-phenylene diamine, said diamine comprising 5 to 20 wt.% of the reaction mixture.

4. A flotation promoter consisting essentially of a fully reacted mixture of an alkyl xanthogen formate with alkyl radicals of 1–6 carbon atoms and an aromatic monoamine selected from the group consisting of o-toluidine and o-xylidine, said monoamine comprising 5 to 40 wt.% of the reaction mixture.

5. The process for beneficiating copper sulfide ores by froth flotation in the presence of a flotation promoter to recover copper concentrate comprising:
providing an aqueous pulp of said ore;
adding as said promoter a mixture of an alkyl xanthogen formate with alkyl radicals of 1–6 carbon atoms and the reaction product of said xanthogen formate and an aromatic amine selected from the group consisting of o-toluene diamine, o-phenylene diamine, o-toluidine and o-xylidine, said amine comprisine 5 to 40 wt.% of the reaction mixture; and
recovering a copper concentrate.

6. The process for producing an improved flotation reagent comprising:
providing an alkyl xanthogen formate having alkyl radicals of 1–6 carbon atoms;
cooling the formate and adding thereto under conditions of agitation the indicated percent of a liquid aromatic amine selected from the group consisting of o-toluene diamine (5–20%) o-phenylene diamine (5–20%) o-toluidine (5–40%) and o-xylidine (5–40%), said percentages being wt. percents of the reaction mixture; and
recovering the resulting mixture comprising unreacted xanthogen formate and the liquid reaction products of said xanthogen formate and said amine.

* * * * *